US006799564B2

(12) United States Patent
Förster et al.

(10) Patent No.: US 6,799,564 B2
(45) Date of Patent: Oct. 5, 2004

(54) IGNITION DEVICE, CONTROLLER AND IGNITION UNIT FOR AN INTERNAL COMBUSTION ENGINE

(75) Inventors: Ralf Förster, Regensburg (DE); Stefan Haimerl, Regensburg (DE); Kurt Kienbaum, Berg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/723,217

(22) Filed: Nov. 26, 2003

(65) Prior Publication Data

US 2004/0123854 A1 Jul. 1, 2004

Related U.S. Application Data

(62) Division of application No. PCT/DE02/01949, filed on May 27, 2002.

(30) Foreign Application Priority Data

Jun. 6, 2001 (DE) ..... 101 27 363

(51) Int. Cl.[7] ..... F02D 3/045
(52) U.S. Cl. ..... 123/644
(58) Field of Search ..... 123/644

(56) References Cited

U.S. PATENT DOCUMENTS 4,736,367 A 4/1988 Wroblewski et al. ..... 370/85
5,571,245 A * 11/1996 Ooyabu et al. ..... 123/644
5,801,534 A * 9/1998 Hohner et al. ..... 123/644
5,871,002 A * 2/1999 Nada ..... 123/644
6,298,837 B1 * 10/2001 Ketterer et al. ..... 123/644

FOREIGN PATENT DOCUMENTS

| | | | |
|---|---|---|---|
| DE | 38 00 932 A1 | 7/1989 | F02P/3/045 |
| DE | 40 20 986 A1 | 1/1992 | F02P/5/145 |
| DE | 42 31 954 A1 | 3/1994 | F02P/3/05 |
| EP | 0 447 975 A1 | 3/1991 | F02P/3/045 |
| EP | 0 555 851 A2 | 2/1993 | F02P/3/04 |
| EP | 0 566 335 A2 | 4/1993 | F02P/3/05 |
| EP | 0 701 060 A2 | 9/1995 | F02P/17/12 |
| JP | 10026069 | 1/1998 | F02P/3/04 |

OTHER PUBLICATIONS

Rodenheber R.: "Neue Treibergeneration für Kfz–Zündsysteme", Elektronik 19; pp. 58–62, 1991.

* cited by examiner

*Primary Examiner*—Erick R. Solis
(74) *Attorney, Agent, or Firm*—Baker Botts L.L.P.

(57) ABSTRACT

An ignition device (2) for an internal combustion engine, a controller (1) for said ignition device (2) and an ignition unit comprising the ignition device (2) and controller (1) are disclosed, whereby the controller (1) is linked to the ignition device (2) by means of a bi-directional control line (5).

11 Claims, 2 Drawing Sheets

IGNITION DEVICE, CONTROLLER AND IGNITION UNIT FOR AN INTERNAL COMBUSTION ENGINE

CROSS REFERENCE TO RELATED APPLICATION

This application is a continuation of copending International Application No. PCT/DE02/01949 filed May 27, 2002, and claiming a priority date of Jun. 6, 2001 which designates the United States.

TECHNICAL FIELD OF THE INVENTION

The invention relates to an ignition device for an internal combustion engine, a controller for said ignition device, and an ignition unit.

BACKGROUND OF THE INVENTION

With internal combustion engines without automatic ignition, ignition of the fuel mixture in the combustion areas of the internal combustion engine generally takes place by means of a spark plug, across which an ignition coil discharges.

It is important here that before the sparking process a sufficiently large quantity of energy is stored in the ignition coil, in order to be able to trigger an ignition spark, which requires a correspondingly large electric current through the ignition coil.

On the other hand the level of electrical energy stored in the ignition coil should also not be too high, as this results in an increased thermal load on the ignition coil and ignition output stage and also increases wear and tear on the spark plug.

Before every ignition process therefore the electrical energy stored in the ignition coil should be within a predefined band, in order to enable an ignition spark to be triggered reliably with a minimal thermal load on the ignition coil and ignition output stage and the lowest possible level of wear and tear on the spark plug.

Ignition output stages to activate the spark plug are known, which are integrated in the electronic engine control unit (ECU). This has the advantage that the electronic engine control unit can detect the current through the ignition coil in order to prevent a further increase in current once the required level of energy is reached in the ignition coil.

It can however be desirable to configure the ignition output stage as a separate component from the electronic engine control unit, whereby the electronic engine control unit transmits the ignition signals to the ignition output stage across a control line.

A disadvantage of such a separate configuration of the electronic engine control unit and the ignition output stage is the fact that the electronic engine control unit is not able to check the electrical energy stored in the ignition coil. Therefore when current is being fed to the ignition coil before the ignition processes, significant safety reserves have to be provided, so that the level of electrical energy stored in the ignition coil is usually higher than necessary, resulting in an increased thermal load on the ignition coil and ignition output stage and also increasing wear and tear on the spark plug.

It is known from RODENHEBER, R: Neue Treibergeneration für Kfz-Zündsysteme (New driver generation for vehicle ignition systems), Elektronik 19/1991, that the ignition coil current can be transmitted from the ignition output stage across a bi-directional control line to the controller, whereby digital gauges are used on the control line.

It is also known from DE 38 00 932 A1 that a controllable current source can be used to feed the ignition coil current back from the ignition output stage to the controller, said controllable current source inputting a predefined current on the control line based on the ignition coil current.

A similar bi-directional data transmission for a vehicle data bus is also known from U.S. Pat. No. 4,736,367.

A disadvantage of the known arrangement is however the fact that only the ignition coil current is transmitted.

SUMMARY OF THE INVENTION

The object of the invention is therefore to make it possible with a separate arrangement of ignition output stage and electronic engine control unit for a plurality of different items of information to be fed back from the ignition output stage to the engine control unit across a single bi-directional control line.

The object can be achieved by an ignition unit with an ignition device and a controller for an internal combustion engine, the ignition device comprising an output for electrical activation of an ignition element for a combustion area of the internal combustion engine, an electrical energy storage device for storing the electrical energy required to activate the ignition element, a control input to record a control signal controlling the charging process for the energy storage device and/or the ignition process from the controller, wherein the control input enables bi-directional data transmission with the controller, in order to give the controller feedback about the charging process for the energy storage device and/or the ignition process for the ignition element, while the control input is connected to a controllable current source in order to input a current signal at the control input to feed back to the controller, wherein the energy storage device is connected to a current metering unit, which records the charging current of the energy storage device, and a controllable sink connected to the control input, in order to input a current signal at the control input to feed back to the controller, whereby the current metering unit is connected to the controllable current sink or to the controllable current source, and the energy storage device is connected to a voltage metering unit, which monitors the ignition voltage, whereby the output side of the voltage metering unit is connected to the controllable current source or the controllable current sink, in order to input the current signal at the control input based on the ignition voltage, the controller comprising a control output for emitting a control signal controlling the charging process for the energy storage device located in the ignition device and/or the ignition process for an ignition element, a driver circuit connected to the control output to generate the control signal, whereby the control output enables bi-directional data transmission, in order to be able to receive feedback from the ignition device about the charging process for the energy storage device and/or the ignition process, a first current metering unit connected to the control output, in order to detect a current signal input by the ignition device, and a second current metering unit connected to the control output, wherein the first current metering unit detects a current signal input by a controllable current sink in the ignition device, while the second current metering unit detects a current signal input by a controllable current source in the ignition device, and the two current metering units are each connected across a controllable switching element to the control output, wherein the controller is connected to the ignition device across a bi-directional control and diagnosis line.

The object can be achieved by an ignition device for an internal combustion engine, comprising an output for electrical activation of an ignition element for a combustion area of the internal combustion engine, an electrical energy storage device for storing the electrical energy required to activate the ignition element, a control input to record a control signal controlling the charging process for the energy storage device and/or the ignition process from a controller, wherein the control input enables bi-directional data transmission with the controller, in order to give the controller feedback about the charging process for the energy storage device and/or the ignition process for the ignition element, while the control input is connected to a controllable current source in order to input a current signal at the control input to feed back to the controller, wherein the energy storage device is connected to a current metering unit, which records the charging current of the energy storage device, and a controllable sink connected to the control input, in order to input a current signal at the control input to feed back to the controller, whereby the current metering unit is connected to the controllable current sink or to the controllable current source, and the energy storage device is connected to a voltage metering unit, which monitors the ignition voltage, whereby the output side of the voltage metering unit is connected to the controllable current source or the controllable current sink, in order to input the current signal at the control input based on the ignition voltage.

The current metering unit may have a precision resistor, which is connected in series to the energy storage device, whereby the precision resistor is connected to an input of a comparator, which compares the voltage decreasing across with precision resistor with a reference current value and activates the controllable current source or the controllable current sink if the reference current value is exceeded. The voltage metering unit may comprise a comparator with two inputs, between which the energy storage device is connected, whereby the comparator activates the controllable current source or the controllable current sink, if a predefined reference voltage value is exceeded. The energy storage device can be connected across a protective resistor to the comparator.

The object can also be achieved by a controller for an ignition device in an internal combustion engine, comprising a control output for emitting a control signal controlling the charging process for an energy storage device located in the ignition device and/or the ignition process for an ignition element, a driver circuit connected to the control output to generate the control signal, whereby the control output enables bi-directional data transmission, in order to be able to receive feedback from the ignition device about the charging process for the energy storage device and/or the ignition process, a first current metering unit connected to the control output, in order to detect a current signal input by the ignition device, and a second current metering unit connected to the control output, wherein the first current metering unit detects a current signal input by a controllable current sink in the ignition device, while the second current metering unit detects a current signal input by a controllable current source in the ignition device, and the two current metering units are each connected across a controllable switching element to the control output.

The control output can be connected to a voltage driver in order to transmit a voltage signal to the ignition device.

The invention embraces the general technical doctrine of enabling a bi-directional data transmission between the controller and the ignition device with a separate configuration of ignition output stage or ignition device on the one hand and electronic engine control unit or controller on the other hand, so that the ignition device can feed back for example the charge status of the ignition coil to the controller.

Instead of or in addition to the charge status of the ignition coil, there is also the possibility of transmitting other information from the ignition device to the controller, such as for example spark combustion duration or the current threshold value of the ignition coil turn-off current.

According to the invention the transmission of information from the ignition device to the controller takes place with the ignition device inputting a current signal on the connecting line between the controller and the ignition device. This is done for example by the ignition device increasing or reducing the electric current drawn from the controller in normal operation across the connecting line by a predefined current adjustment.

According to the invention the ignition device here has a controllable current sink and a controllable current source, which is connected to the control input. When the controllable current sink is activated, the electric current drawn from the controller is increased, while the electric current drawn from the controller is reduced when the controllable current source in the ignition device is activated, each of which processes can be identified by the controller.

For this purpose the controller preferably has at least one current metering unit, which detects the electric current drawn from the ignition device and as a result can identify activation of the controllable current source or the controllable current sink in the ignition device.

It has already been stated above that it is desirable for the ignition device to notify the separate controller of the charge status of the ignition coil, so that the charging process for the ignition coil or the starting up of the electric current through the ignition coil can be started promptly. According to the invention therefore a current metering unit is provided which measures the electric current flowing through the ignition coil and is connected on the output side to the controllable current source or the controllable current sink, in order to transmit a corresponding signal to the controller when a predefined threshold value for the electric current flowing through the ignition coil is reached or exceeded. Preferably the current flowing through the ignition coil is measured here by a precision resistor connected in series to the ignition coil and connected to the input of a comparator, whereby the comparator measures the decreasing voltage across the precision resistor, which is proportional to the electric current flowing through the ignition coil. The comparator here compares the identified current value with a predefined reference current value and activates the controllable current source or the controllable current sink, if the reference current value is exceeded.

Within the context of the invention it is also possible for the ignition device to notify the controller of the spark combustion duration. According to the invention therefore a voltage metering unit connected to the ignition coil is provided, which monitors the ignition voltage, whereby the voltage metering unit is connected on the output side to the controllable current source or the controllable current sink, in order to supply a signal based on the ignition voltage to the controller. In the preferred embodiment the voltage metering unit is connected on the output side to a comparator, which compares the measured ignition voltage with predefined reference voltage value and activates the controllable current source or the controllable current sink if said voltage is above or below the predefined reference voltage value.

The signals transmitted by the ignition device are preferably analyzed in the controller by a current metering unit, which detects the electric current drawn from the ignition device across the connecting line. The current metering unit here preferably comprises a comparator, which compares the measured current value with a predefined reference current value and generates a digital output signal accordingly.

BRIEF DESCRIPTION OF THE DRAWINGS

Other advantageous developments are described below together with the description of the preferred embodiment with reference to the figures, in which.

DETAILED DESCRIPTION OF THE PREFERRED EMBODIMENTS

Figure 1:
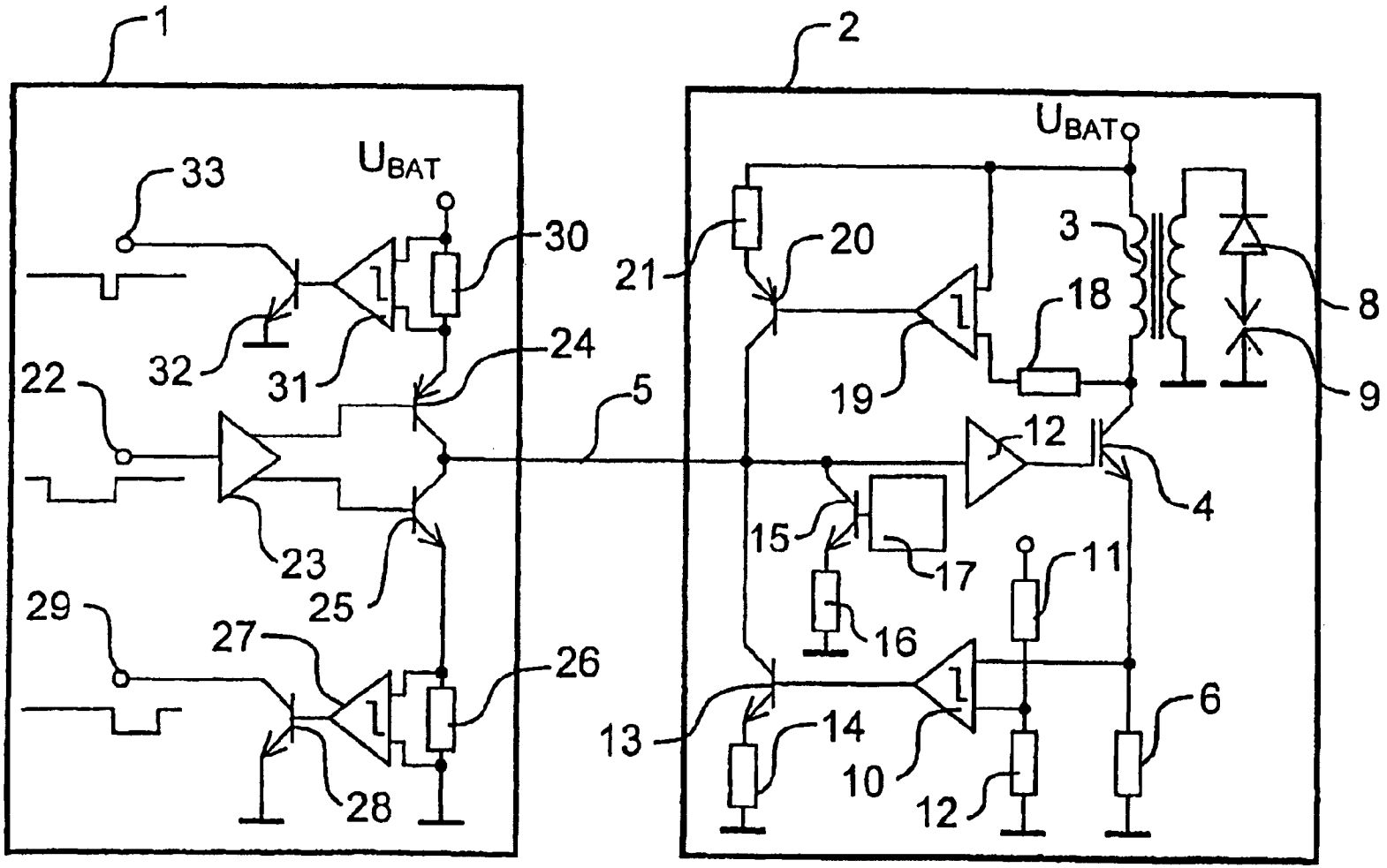
FIG. 1 shows an ignition unit according to the invention.

The ignition unit shown in FIG. 1 comprises a controller 1 and an ignition device 2 with an integrated ignition coil 3 and a similarly integrated ignition output stage 4, whereby the controller 1 is connected across a bi-directional control line 5 to the ignition device 2.

The control line 5 on the one hand allows the charging process for the ignition coil 3 to be controlled and on the other hand allows feedback from the ignition device 2 to the controller 1 about the charge status of the ignition coil 3 and the spark combustion duration, as described in detail below.

The structures of the ignition device 2 and the controller 1 are first described below in order then to be able to look in more detail at their operating principles.

The ignition coil is connected in series to the ignition output stage 4 comprising an IGBT and a precision resistor 6 between the battery voltage $U_{BAT}$ and earth, so that the ignition coil 3 forms an RL element with the precision resistor 6 when the ignition output stage 4 is switched through.

Figure 2:
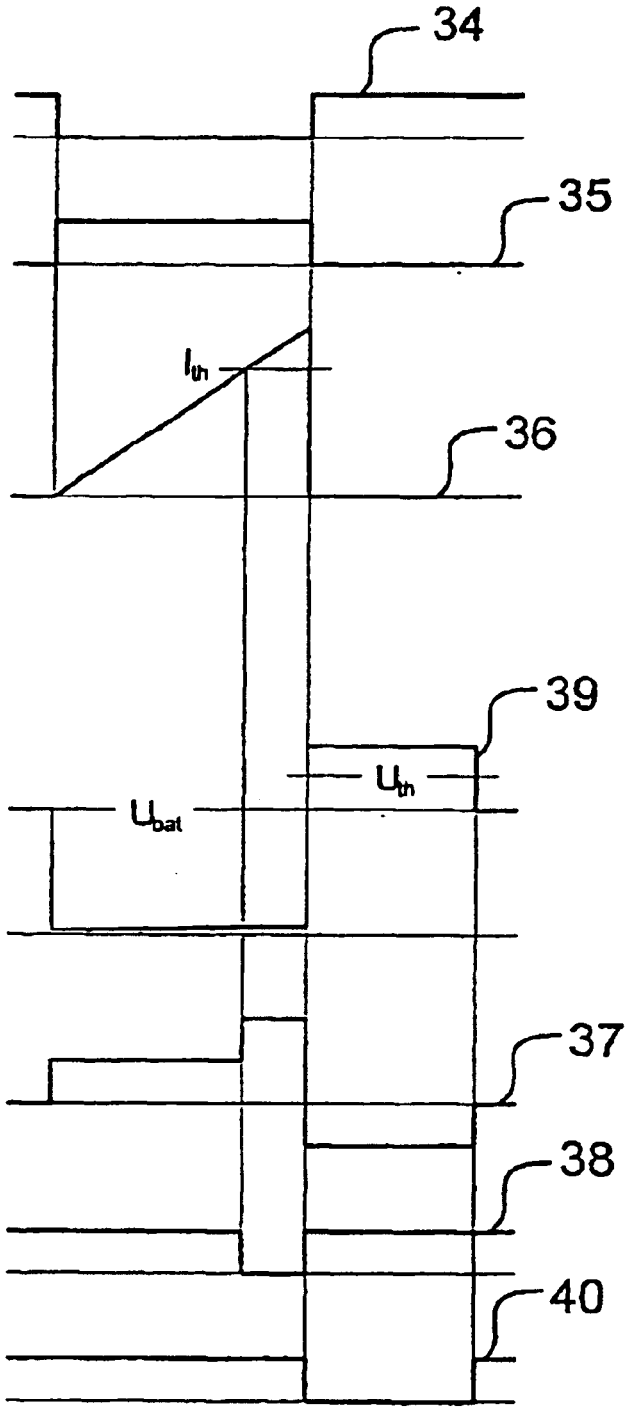
FIG. 2 shows pulse diagrams to clarify the data transmission between the controller and the ignition device.

The gate of the ignition output stage 4 is connected across a driver 7 to the control input of the ignition device 2, across which the ignition device 2 is connected by the bi-directional control line 5 to the controller 1. The controller 1 can therefore switch through the ignition output stage 4 across the bi-directional control line 5, whereupon the electric current through the ignition coil 3 increases in a largely linear manner, as shown in FIG. 2.

On the output side the ignition coil 3 is connected across a diode 8 to a spark plug 9, so that when the ignition output stage 4 is blocked, the ignition coil 3 can discharge across the spark plug 9, thereby generating an ignition spark.

A tap for voltage metering is provided between the ignition output stage 4 and the precision resistor 6 and is connected to a metering input of a comparator 10. The other input of the comparator is connected to a central tap of a voltage divider, which comprises two resistors 11, 12, whereby the size of the resistor 12 defines a reference current value for charging the ignition coil 3.

On the output side the comparator 10 is connected to the base of a transistor 13, which connects the control input of the ignition device across a resistor 14 to earth and forms a controllable current sink. When the transistor 13 is switched through, the control input of the ignition device 2 is drawn to earth specifically across the resistor 14, so that the ignition device 2 draws an additional current from the controller across the bi-directional connecting line and this can be identified by said controller. The transistor 13 is switched through when the comparator 10 identifies that the electric current flowing through the ignition coil 3 exceeds the predefined reference current value.

The ignition device 2 also has a further controllable current sink, which comprises a transistor 15 and an earthed resistor 16, whereby the transistor 15 is activated by a diagnosis circuit 17 only shown in outline.

Finally the ignition device 2 also enables transmission of the spark combustion duration. For this the earth-side connection of the ignition coil 3 is connected across a resistor 18 to an input of a comparator 19, whereby the other input of the comparator 19 is connected to the battery voltage $U_{BAT}$. The comparator 19 therefore compares the electric voltage decreasing across the ignition coil 3 with a predefined reference voltage value, in order to be able to determine whether an ignition spark is emitted.

On the output side the comparator is connected to a controllable current source, which comprises a transistor 20 and a resistor 21, whereby the transistor 20 connects the control input of the ignition device 2 to the battery voltage $U_{BAT}$ during switching through across the resistor 21, so that the current source drives a current across the bi-directional control line, resulting in a decrease in the electric current drawn from the ignition device 2 across the bi-directional control line from the controller 1, as shown in FIG. 2.

The structure of the controller 1 is described below.

To initiate the charging process for the ignition coil 3 the controller has a connection 22, which can be activated for example by a microprocessor (not shown). The connection is low-active and connected across a driver 23 to the bases of two transistors 24, 25, whereby the driver 23 is used for level adjustment between the bi-directional control line 5 and the connection 22 for connection to a microprocessor. In the event of a logical low level at the connection 22 the transistor 24 switches through, while the transistor 25 switches through in the event of a high level.

The transistor 25 here is earthed on the earth side across a precision resistor 26 and in the context of ignition diagnosis is used to determine the spark combustion duration transmitted from the ignition device 2 across the bi-directional control line 5. For this the precision resistor 26 is connected to the two inputs of a comparator 27, which thereby compares the current flowing through the precision resistor 26 with a predefined reference value.

On the output side the comparator 27 is connected to the base of a transistor 28, which earths a connection 28 during switching through. The digital signal at the connection 29 therefore reflects the current through the precision resistor and is at low for the duration of spark combustion.

The transistor 24 is connected across a precision resistor 30 to battery voltage $U_{BAT}$, whereby the precision resistor 30 is in turn connected to the two inputs of a comparator 31, which thereby compares the electric current flowing through the precision resistor 30 with a predefined reference value.

On the output side the comparator 31 is connected to the base of a transistor 32, which earths a connection 33 during switching through, so that the connection 33 assumes a low level, when the current through the precision resistor 30 exceeds the predefined reference value.

The operating principle of the arrangement described above is described below with reference to the signal patterns shown in FIG. 2.

A signal 34 is present at the connection 22 of the controller 1, said signal being generated by a microprocessor (not shown), whereby the signal 34 switches through the transistor 24 during the low phase and the transistor 25 during the high phase, so that the bi-directional control line 5 assumes a predefined signal pattern 35 with a specific electrical potential.

Switching through the transistor 24 in turn causes the ignition output stage 4 in the ignition device 2 to switch through, so that a current increasing in an approximately linear manner flows through the series connection of the ignition coil 3, the ignition output stage 4 and the precision resistor 6 with a predefined signal pattern 36. The linearity of the current pattern 36 is due to the fact that the inductivity of the ignition coil 3 is not constant.

The increase in the electric current through the ignition coil 3 and the precision resistor 6 results in an increasing voltage difference at the inputs of the comparator so that the comparator 10 switches through the transistor 13, when the current through the ignition coil 3 reaches a predefined threshold value $I_{th}$. Switching through the transistor 3 then results in the bi-directional control line 5 in the ignition device 2 being earthed across the resistor 14, so that a larger current flows across the bi-directional control line 5, as can be seen from the signal pattern 37. The larger current flow across the resistor 30 and the bi-directional control line 5 causes the comparator 31 to switch through the transistor 32, so that the connection 33 is earthed, as shown in the signal pattern 38.

The low phase of the signal pattern 38 is analyzed by a counter in the microprocessor (not shown). After the end of a predefined period the microprocessor resets the connection to logical high so that the transistor 24 blocks and the transistor 25 switches through, whereby the electrical potential on the bi-directional control line is drawn to logical low, as can be seen from the signal pattern 35. Blocking the transistor 24 also results in the ignition output stage 4 being blocked, whereupon the current through the ignition coil 3 suddenly drops, as can be seen from the signal pattern 36.

As the current through the ignition coil 3 cannot change suddenly due to the inductivity of the ignition coil 3, the ignition coil 3 discharges across the spark plug 9, so that an ignition spark is emitted. A voltage is hereby induced in the primary side of the ignition coil 3, as can be seen from the signal pattern 39. The primary-side induction of voltage in the ignition coil during the ignition process results in the comparator 19 switching through the transistor 20 of the controllable current source, so that the ignition device 2 drives a current across the bi-directional control line 5 in the direction of the controller 1, as can be seen from the signal pattern 37. During the ignition process the polarity of the current flowing across the bi-directional control line 5 therefore changes. The current driven by the ignition device in this way flows across the transistor 25 and the precision resistor 26 to earth, so that the comparator 27 switches through the transistor 28, whereupon the connection 29 is earthed, as can be seen from the signal pattern 40. The low level at the connection 29 therefore signals the duration of the ignition spark. In this way the microprocessor (not shown) connected to the connection 29 can identify whether the electrical energy stored in the ignition coil 3 before the actual ignition process has been sufficient to trigger an ignition spark.

The invention is not restricted to the embodiment described above. Rather a plurality of variants and modifications are possible, which also utilize the inventive idea and come into the scope of the patent.

We claim:

1. An ignition device for an internal combustion engine, comprising:

an output for electrical activation of an ignition element for a combustion area of the internal combustion engine, an electrical energy storage device for storing the electrical energy required to activate the ignition element, a control input to record a control signal controlling the charging process for the energy storage device and/or the ignition process from a controller, wherein the control input enables bi-directional data transmission with the controller, in order to give the controller feedback about the charging process for the energy storage device and/or the ignition process for the ignition element, while the control input is connected to a controllable current source in order to input a current signal at the control input to feed back to the controller, wherein the energy storage device is connected to a current metering unit, which records the charging current of the energy storage device, and a controllable sink connected to the control input, in order to input a current signal at the control input to feed back to the controller, whereby the current metering unit is connected to the controllable current sink or to the controllable current source, and the energy storage device is connected to a voltage metering unit, which monitors the ignition voltage, whereby the output side of the voltage metering unit is connected to the controllable current source or the controllable current sink, in order to input the current signal at the control input based on the ignition voltage.

2. The ignition device according to claim 1, wherein the current metering unit has a precision resistor, which is connected in series to the energy storage device, whereby the precision resistor is connected to an input of a comparator, which compares the voltage decreasing across with precision resistor with a reference current value and activates the controllable current source or the controllable current sink if the reference current value is exceeded.

3. The ignition device according to claim 1, wherein the voltage metering unit comprises a comparator with two inputs, between which the energy storage device is connected, whereby the comparator activates the controllable current source or the controllable current sink, if a predefined reference voltage value is exceeded.

4. The ignition device according to claim 3, wherein the energy storage device is connected across a protective resistor to the comparator.

5. A controller for an ignition device in an internal combustion engine, comprising:

a control output for emitting a control signal controlling the charging process for an energy storage device located in the ignition device and/or the ignition process for an ignition element, a driver circuit connected to the control output to generate the control signal, whereby the control output enables bi-directional data transmission, in order to be able to receive feedback from the ignition device about the charging process for the energy storage device and/or the ignition process, a first current metering unit connected to the control output, in order to detect a current signal input by the ignition device, and a second current metering unit connected to the control output, wherein the first current metering unit detects a current signal input by a controllable current sink in the ignition device, while the second current metering unit detects a current signal input by a controllable current source in the ignition device, and the two current metering units are each connected across a controllable switching element to the control output.

6. The controller according to claim 5, wherein the control output is connected to a voltage driver in order to transmit a voltage signal to the ignition device.

7. An ignition unit with an ignition device and a controller for an internal combustion engine, the ignition device comprising:

an output for electrical activation of an ignition element for a combustion area of the internal combustion engine, an electrical energy storage device for storing the electrical energy required to activate the ignition element, a control input to record a control signal controlling the charging process for the energy storage device and/or the ignition process from the controller, wherein the control input enables bi-directional data transmission with the controller, in order to give the controller feedback about the charging process for the energy storage device and/or the ignition process for the ignition element, while the control input is connected to a controllable current source in order to input a current signal at the control input to feed back to the controller, wherein the energy storage device is connected to a current metering unit, which records the charging current of the energy storage device, a controllable sink connected to the control input, in order to input a current signal at the control input to feed back to the controller, whereby the current metering unit is connected to the controllable current sink or to the controllable current source, and the energy storage device is connected to a voltage metering unit, which monitors the ignition voltage, whereby the output side of the voltage metering unit is connected to the controllable current source or the controllable current sink, in order to input the current signal at the control input based on the ignition voltage, the controller comprising:

a control output for emitting a control signal controlling the charging process for the energy storage device located in the ignition device and/or the ignition process for an ignition element, a driver circuit connected to the control output to generate the control signal, whereby the control output enables bi-directional data transmission, in order to be able to receive feedback from the ignition device about the charging process for the energy storage device and/or the ignition process, a first current metering unit connected to the control output, in order to detect a current signal input by the ignition device, a second current metering unit connected to the control output, wherein the first current metering unit detects a current signal input by a controllable current sink in the ignition device, while the second current metering unit detects a current signal input by a controllable current source in the ignition device, and the two current metering units are each connected across a controllable switching element to the control output, wherein the controller is connected to the ignition device across a bi-directional control and diagnosis line.

8. The ignition unit according to claim 7, wherein the current metering unit has a precision resistor, which is connected in series to the energy storage device, whereby the precision resistor is connected to an input of a comparator, which compares the voltage decreasing across with precision resistor with a reference current value and activates the controllable current source or the controllable current sink if the reference current value is exceeded.

9. The ignition unit according to claim 7, wherein the voltage metering unit comprises a comparator with two inputs, between which the energy storage device is connected, whereby the comparator activates the controllable current source or the controllable current sink, if a predefined reference voltage value is exceeded.

10. The ignition unit according to claim 9, wherein the energy storage device is connected across a protective resistor to the comparator.

11. The ignition unit according to claim 7, wherein the control output is connected to a voltage driver in the controller in order to transmit a voltage signal to the ignition device.

* * * * *

UNITED STATES PATENT AND TRADEMARK OFFICE

CERTIFICATE OF CORRECTION

PATENT NO. : 6,799, 564 B2
DATED : October 5, 2004
INVENTOR(S) : Förster et al.

It is certified that error appears in the above-identified patent and that said Letters Patent is hereby corrected as shown below:

Title page,
Item [62], Related U.S. Application Data, delete "Divison" and replace with
-- Continuation --

Signed and Sealed this

Nineteenth Day of April, 2005

JON W. DUDAS
*Director of the United States Patent and Trademark Office*